US008984842B2

(12) United States Patent
Muder

(10) Patent No.: US 8,984,842 B2
(45) Date of Patent: Mar. 24, 2015

(54) METHOD AND APPARATUS FOR ASSEMBLING FIELD ERECTED COOLING TOWER FRAME

(71) Applicant: Evapco, Inc., Taneytown, MD (US)

(72) Inventor: Mark Andrew Muder, Olathe, KS (US)

(73) Assignee: Evapco, Inc., Taneytown, MD (US)

( * ) Notice: Subject to any disclaimer, the term of this patent is extended or adjusted under 35 U.S.C. 154(b) by 0 days.

(21) Appl. No.: 13/783,028

(22) Filed: Mar. 1, 2013

(65) Prior Publication Data

US 2013/0232910 A1 Sep. 12, 2013

Related U.S. Application Data

(60) Provisional application No. 61/605,660, filed on Mar. 1, 2012.

(51) Int. Cl.

| | |
|---|---|
| ***E04B 1/00*** | (2006.01) |
| ***E04H 12/34*** | (2006.01) |
| ***E04H 5/12*** | (2006.01) |
| ***E04G 1/22*** | (2006.01) |

(52) U.S. Cl.

CPC ..... *E04H 12/34* (2013.01); *E04H 5/12* (2013.01); *E04G 1/22* (2013.01)

USPC ..... 52/745.18; 52/651.1

(58) Field of Classification Search

USPC ..... 52/745.18, 651.1; 182/82, 126

See application file for complete search history.

(56) References Cited

U.S. PATENT DOCUMENTS

| | | | | | |
|---|---|---|---|---|---|
| 2,828,166 | A * | 3/1958 | Herring | 182/101 |
| 2,904,126 | A * | 9/1959 | Meng et al. | 182/103 |
| 3,438,460 | A * | 4/1969 | Solari | 182/132 |
| 3,612,219 | A * | 10/1971 | Fortner | 182/126 |
| 3,817,347 | A * | 6/1974 | Spencer | 182/115 |
| 4,294,332 | A * | 10/1981 | Ready | 182/141 |
| 4,809,814 | A * | 3/1989 | St-Germain | 182/132 |
| 4,832,315 | A | 5/1989 | Vanderklaauw | |
| 5,135,077 | A * | 8/1992 | Shalders | 182/82 |
| 5,159,993 | A * | 11/1992 | St-Germain | 182/82 |
| 5,430,903 | A | 7/1995 | Pence | |
| 6,260,646 | B1 | 7/2001 | Fernandez et al. | |
| 6,695,097 | B1 * | 2/2004 | Wiklund | 182/141 |
| 7,140,467 | B2 * | 11/2006 | Cook | 182/143 |
| 2007/0000724 | A1 * | 1/2007 | Anasis et al. | 182/141 |
| 2011/0078976 | A1 | 4/2011 | Abeln et al. | |
| 2011/0296789 | A1 | 12/2011 | Collins et al. | |

* cited by examiner

*Primary Examiner* — Basil Katcheves

(74) *Attorney, Agent, or Firm* — Whiteford, Taylor & Preston, LLP; Peter J. Davis

(57) ABSTRACT

A method and structure for assembling field erected cooling. A first cell or cell portion is assembled at the opposite end of the cooling basin from its final location and used as a scaffold from which the rest of the structure is assembled. This first "assembly" section is fitted with temporary walkways, safety railings and enclosed ladders and workers assemble each new section of the cooling tower frame from the scaffold affixed to the first section. After assembly of each section or bay of the cooling tower frame is completed, the assembly section is advanced away from the newly constructed section to make room for the assembly of a new section. To advance the assembly section, movable lifts are positioned under the bottom transverse beams of the section.

12 Claims, 7 Drawing Sheets

PLAN VIEW AT TOP OF SCISSOR JACKS
(TOWER GIRTS NOT SHOWN FOR CLARITY)

METHOD AND APPARATUS FOR ASSEMBLING FIELD ERECTED COOLING TOWER FRAME

FIELD OF THE INVENTION

The present invention relates to cooling towers, and in particular to the framework assembly for large field erected cooling towers.

BACKGROUND OF THE INVENTION

The frame assembly of large multi-cell field erected cooling towers is a complex, labor-intensive, repetitive and potentially dangerous process. While sizes and relative dimensions vary widely, large scale field erected cooling towers often consist of as many as eight or more units or "cells," and a typical cell can be 40 or more feet in height, 60 or more feet in length, and 60 or more feet in width. Each cell is typically composed of 4 to 10 component sections or "bays," which can be longitudinal or transverse. FIG. 1 shows (on the bottom) a nearly finished cooling tower having eight cells, totaling nearly 500 feet in length. At the top of FIG. 1, an unfinished cooling tower of equivalent size is shown in the frame assembly stage.

Frame assembly is generally carried out in one of two ways. According to a first "stick" assembly process, each individual piece of the frame is moved into place, one at a time, either by hand, or with assistance with a crane or lift, and sequentially bolted or otherwise fixed to adjacent pieces. As the frame rises into the air, workers climb up, down, and through already assembled portions of the frame to place and bolt new pieces. Hence, beginning from bottom to top, and from one side to the other, the frame is assembled manually, one piece at a time. For safety, workers use safety harnesses attached to already-assembled portions of the frame, and the harnesses need to be detached and moved to a different part of the frame and the assembly progresses.

According to a different assembly process, sequential two dimensional sections of the frame are assembled on the ground, then lifted into place with a crane or other lift, one at a time, and fixed to adjacent sections with transverse members. While this process reduces the time workers spend in the height of the structure placing and connecting the elements that contribute to the height of the structure, the workers must still move in and among the structure at various heights connecting each two dimensional section or "face" to the next.

SUMMARY OF THE INVENTION

The present invention presents a method and structure for assembling the frames of large field erected cooling towers according to which a first cell or cell portion is constructed using standard techniques. According to the invention, this first cell or cell portion is assembled at the opposite end of the cooling basin from its final location, and it is used as a scaffold from which the rest of the structure is assembled. This first section is fitted with temporary walkways, safety railings and ladders to allow workers to easily and safely move within and along one face of the structure, and to allow the workers assemble each new section of the cooling tower frame from the safety of the scaffold that is affixed to the first section. After assembly of each section or bay of the cooling tower frame is completed, the first section is advanced away from the newly constructed section to make room for the assembly of a new section. Accordingly, the first cell or cell portion, with affixed safety scaffolding, is advanced down the length of the cooling tower basin on which the cooling tower frame is assembled. The first cell or cell portion may thus appropriately be referred to as the assembly section, the scaffold section, or the advancing section. To advance this assembly/scaffold/advancing section, movable lifts are positioned under the bottom transverse beams of the section (or under temporary structural beams that are beneath the bottom transverse beams solely for the purpose of moving the section), the section is lifted off the ground, often as little as 1-2 inches and usually no more than 6 inches, and the section is pushed or pulled a distance sufficient, usually six feet, but sometimes as much as twelve feet, to make room for assembly of the next section or "bay." The assembly/scaffold/advancing section has an advancing face, which faces the direction of advance, and a trailing face, which bears the scaffold walkways and railings and which faces the portion of the cooling tower frame that is being assembled.

According to an aspect of the present invention, the workers may remain stationed on the advancing section as it is advanced.

According to another aspect of the present invention, the advancing section may be used to store structural members used in the assembly of the rest of the cooling tower frame.

According to another aspect of the present invention, the weight of stored structural members may be used to add stability to the advancing section.

DESCRIPTION OF THE DRAWINGS

The subsequent description of the preferred embodiments of the present invention refers to the attached drawings, wherein.

DETAILED DESCRIPTION OF THE INVENTION

Figure 1:
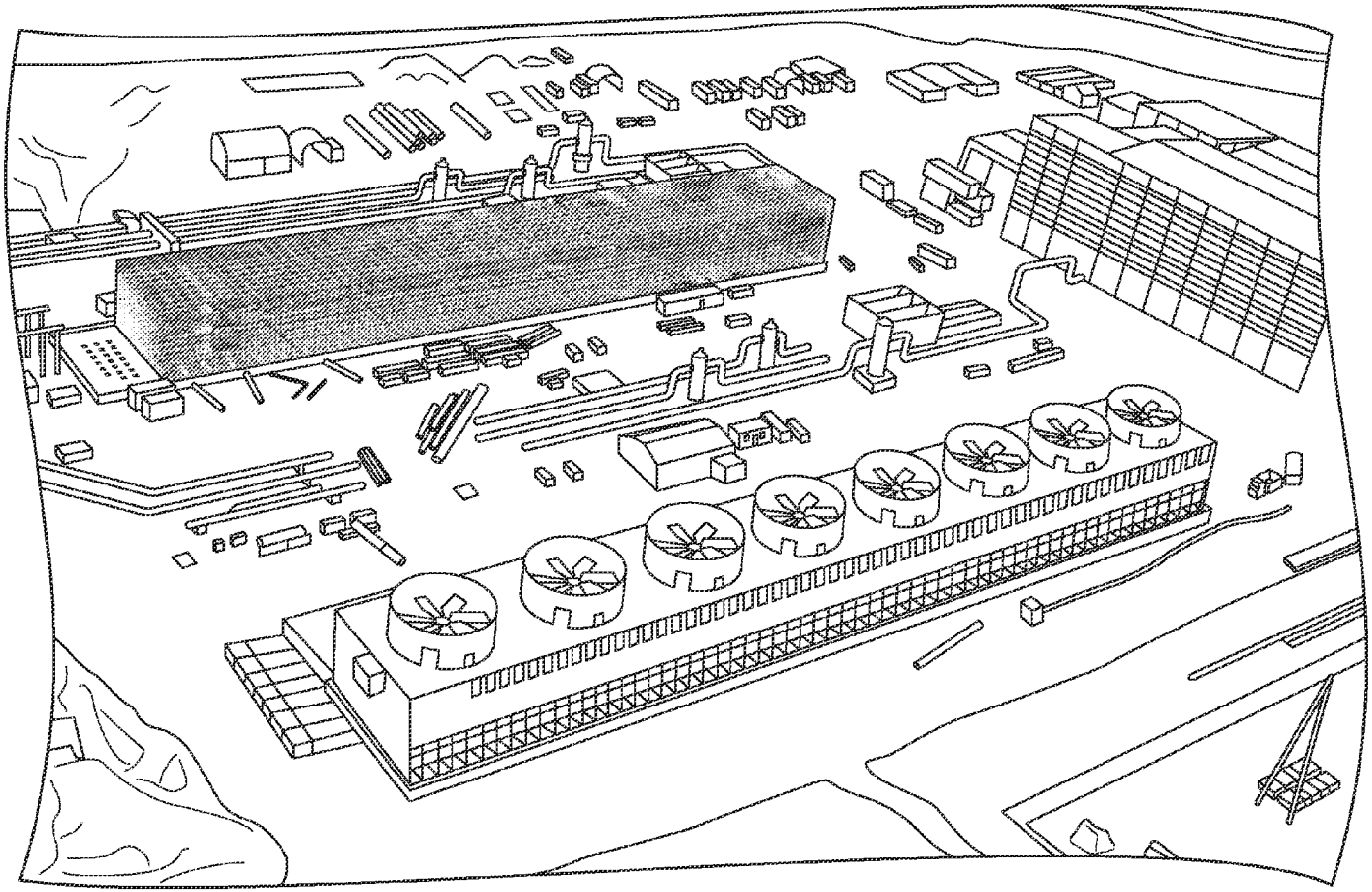
FIG. 1 shows a fully assembled cooling tower including external sheathing and fan housings (bottom), and a partially assembled cooling tower (top) showing the cooling tower frame.
Figure 2:
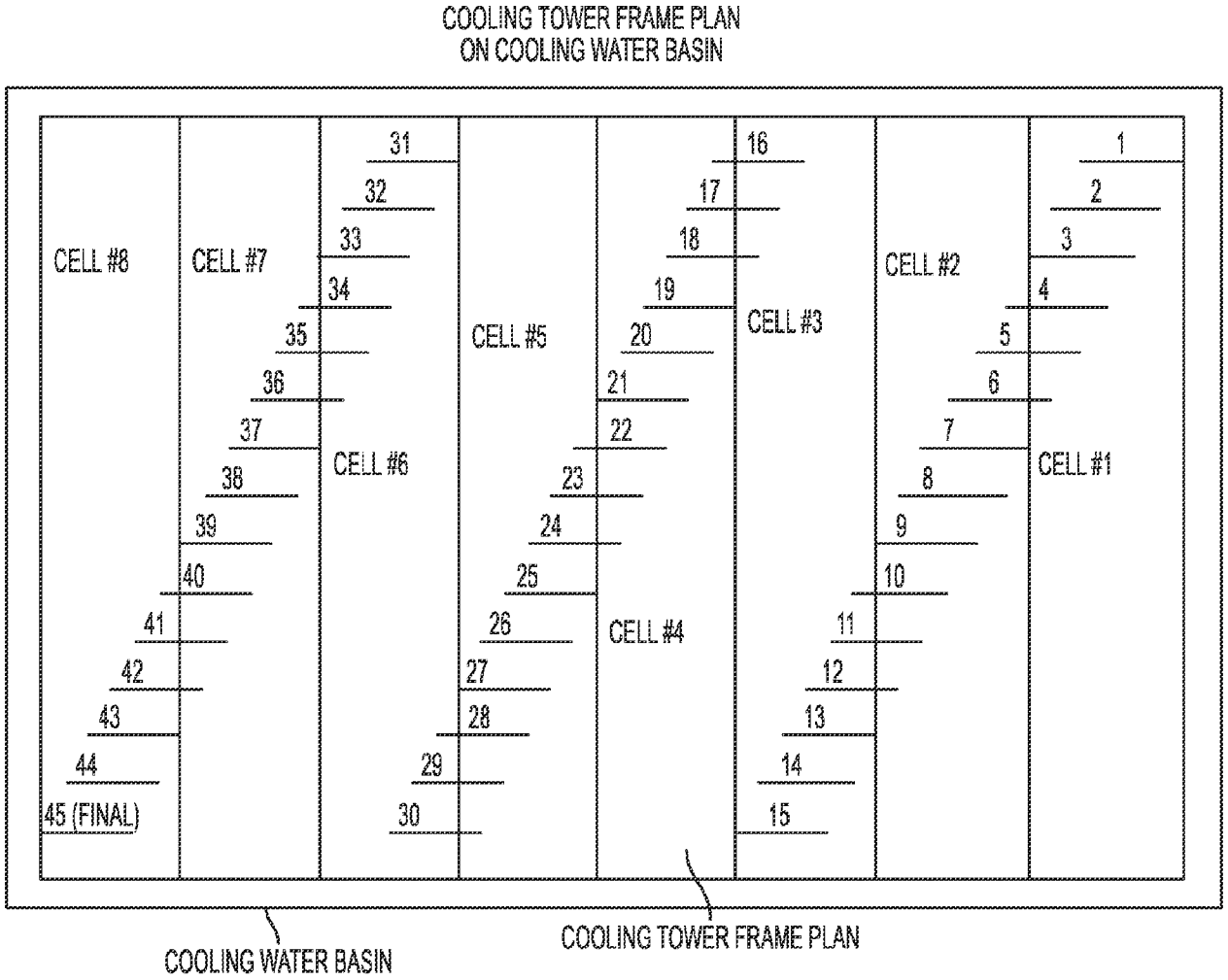
FIG. 2 is a plan view of a cooling tower basin overlaid with the final locations of each cell of an eight cell cooling tower, as well as position numbers for various longitudinal positions of the advancing assembly structure during sequential assembly stages.

FIG. 2 is a plan view of a cooling tower basin of the type over which cooling towers like those illustrated in FIG. 1 are assembled. FIG. 2 also shows the final locations of each cell of an eight cell cooling tower. Finally, FIG. 2 also shows the longitudinal positions of the assembly/advancing structure, advancing in quantum steps towards its final location as each additional section is assembled (preferably, the assembly structure takes up the entire transverse dimension of the cooling tower frame). FIG. 2 reflects an eight cell cooling tower, each having 6 longitudinal bays (not shown, but reflected by advancing numbered positions of the assembly section). The invention may be used to assemble a cooling tower having any number of cells, but economics of this process indicate that it is progressively more effective as the number of cells increases.

Referring to FIG. 2, the assembly structure is itself assembled at position #1, in the final location of cell #1, and the walkways, railings and ladders are assembled to the trailing face of the assembly structure. The assembly structure can constitute an entire cell, in which case it will temporarily be located in, and take up the entire space of, the final location for cell #1. Alternatively, the assembly structure can constitute a portion of an entire cell, but preferably no less than 4 bays, and more preferably no less than 6 bays, in the longitudinal direction. In the case where the assembly structure constitutes only a portion of an entire cell, then when it is assembled in the final location of cell #1, it will only take up a portion of the space that will eventually be occupied by cell #1.

Once the assembly structure is assembled, and the walkways, railings and ladders attached on the trailing face, movable lifts are moved under the lowest transverse beams of the assembly structure (they are mounted on the vertical columns, several inches above the floor and may be temporary beams that are not part of the final structure), and the lifts are activated to lift the assembly structure off the floor. The assembly structure is then advanced in the direction of the final location of cell #8 by a distance sufficient to make room for assembly of the first bay of cell #1, and the assembly section is then lowered back to the floor. In a safe environment, workers navigate the walkways and ladders of the assembly section, assembling bay #1 of cell #1, in its final location. According to a preferred embodiment, structure elements for the assembly of bay #1 of cell #1 may have been placed across the longitudinal and/or transverse elements of the assembly structure for easy and ready access by the workers. The stockpile of materials stored in the structure of the assembly section may be refreshed from the leading face or a side face of the assembly section, as necessary. The structure of bay #1 of cell #1 is preferably not affixed to the assembly structure, although some temporary stabilizing connection may be used, since during initial assembly of cell #1, the partially constructed cell #1 is not highly stable due to a relative tall height and narrow cross-section.

When the assembly of bay #1, cell #1 is completed, the assembly structure is once again lifted using the movable lifts, advanced roughly the distance of a single bay, to position #2, FIG. 2, leaving bay #1 of cell #1 where it was erected. According to a preferred embodiment, the workers need not leave the assembly structure and may remain safely on the walkways while the structure is moving. When the assembly structure has been advanced to leave sufficient room to assemble bay #2 of cell #1, it is lowered to ground, and assembly of bay #2 of cell #1 commences, as well as the connection of bay #2 to bay #1. As with the assembly of bay #1, cell #1, the workers can conduct the assembly of bay #2, cell #1 from the safety of the walkways on the trailing face of the assembly section. Likewise, the workers can connect bay #2, cell #1 to bay #1, cell #1 without leaving the safety of the walkways, as the assembly of each section may include attachment of the longitudinal structural elements that connect it to a subsequently assembled section. When the assembly of bay #2, cell #1 and its connection to bay #1, cell #1 is completed, the assembly section is once again lifted, advanced, and lowered in position #3.

In this fashion, the assembly section is advanced in quantum steps down the length of the cooling tower basin, and the walkways attached to the trailing face of the assembly structure are used to allow workers to safely assemble the entire cooling tower frame, bay by bay, and cell by cell, in their final locations. Referring to FIG. 2, the assembly section is advanced to each of positions #3 through #45, as each section is completed. Once the assembly section is advanced into its final location (position #45) at the opposite end of the cooling tower basin from where it was assembled, the final bay (final in terms of assembly order, not in terms of location) is assembled between the most recently assembled bay and the assembly section, and the final bay is connected to both the previously assembled bay and to the assembly section, which, as described previously, constitutes the terminal bays of the cooling tower frame. The walkways, railings and ladders are removed, and the assembly of the cooling tower frame is complete.

According to this method, the inventors have determined that assembly of an eight cell cooling tower can progress at three times the rate of assembly using conventional procedures, with a large percentage of all frame connections made from the safety of the walkways.

Figure 3:
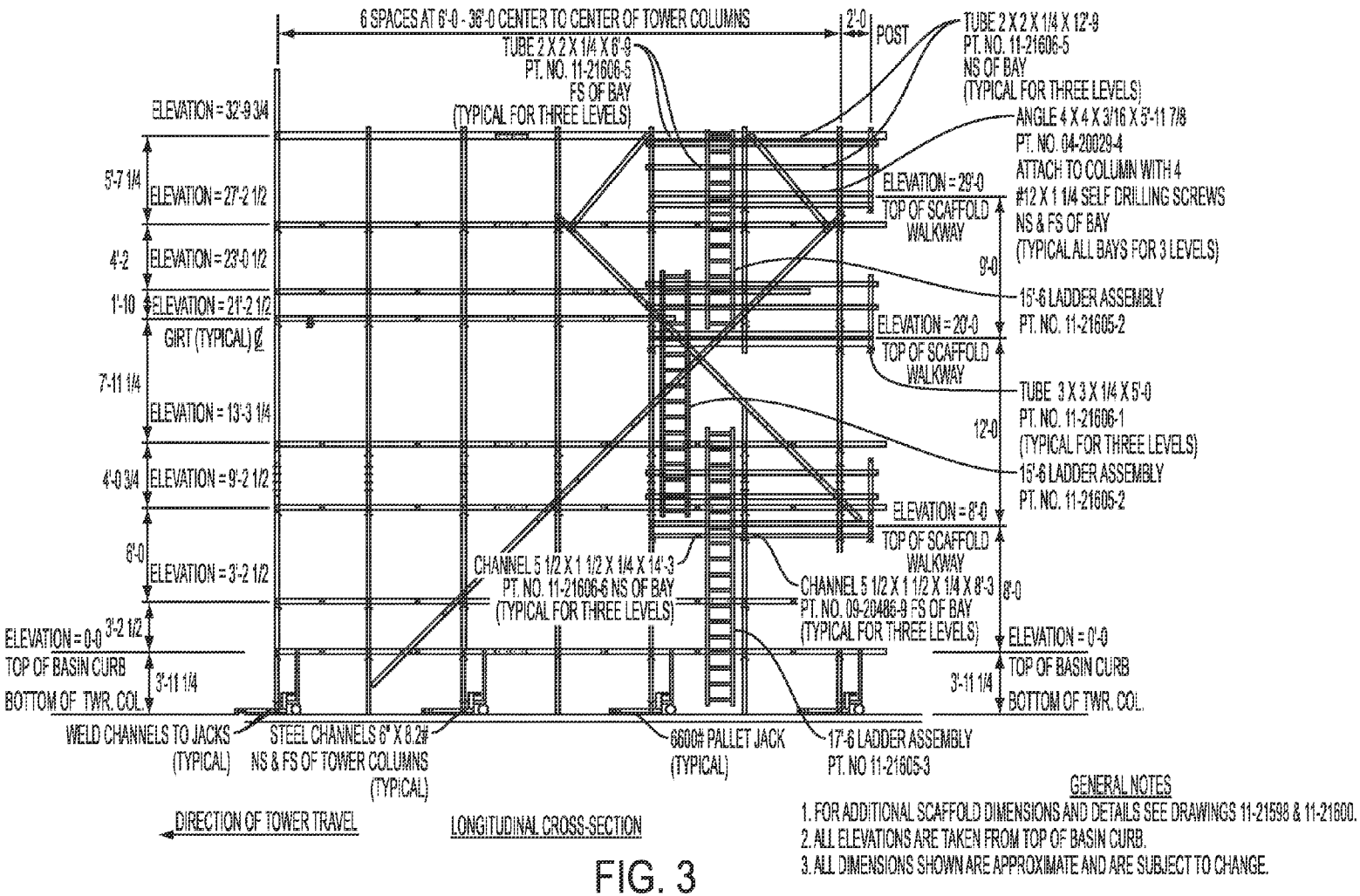
FIG. 3 is a longitudinal section (side view) schematic of a six bay assembly section with affixed scaffolding walkways, railings and ladders.

FIG. 3 shows a six bay (length)×9 bay (width) assembly section for a cooling tower in which each cell is 9 bay×9 bay. Thus, the assembly section shown in FIG. 3 illustrates an embodiment where the assembly section does not constitute the entire structure of the final cell (#8, in this example). Instead, according to the embodiment of the assembly section shown in FIG. 3, the last three longitudinal bays of cells #8 would be assembled as the assembly section is advanced through its three final assembly locations along the cooling tower basin. The assembly section of FIG. 3 has a leading face and a trailing face. Three levels of walkways, railings and connecting ladders are affixed to the assembly framework at the trailing face. Movable lifts are shown under each bottom transverse beam.

Figure 4:
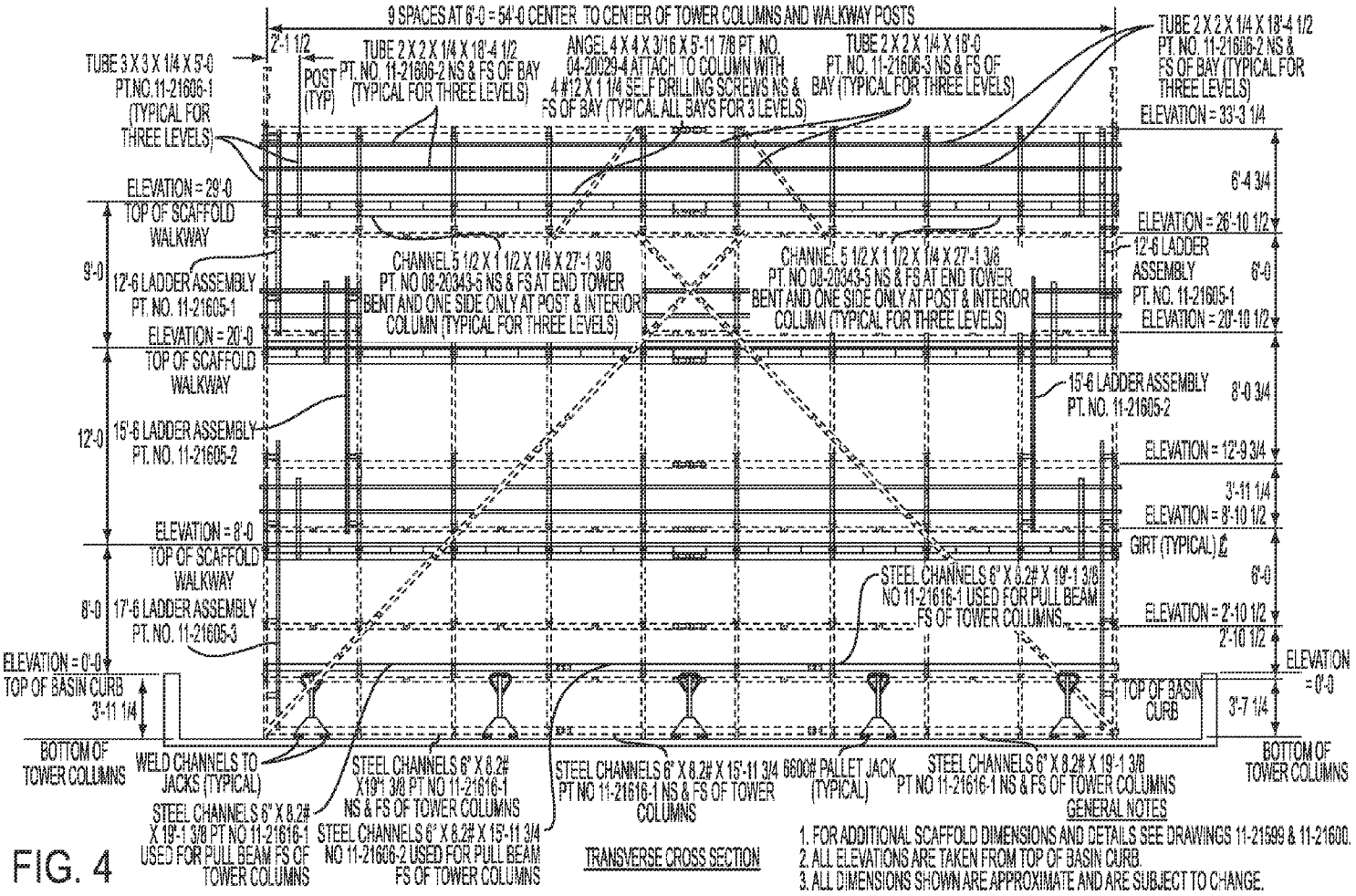
FIG. 4 is a transverse section (trailing face view) schematic of the six bay assembly section shown in FIG. 3.

FIG. 4 shows the same assembly section shown in FIG. 3, in transverse cross-section, and therefore reflects the 9 bays in width. The walkways, railings and ladders are also shown in FIG. 4.

Figure 5:
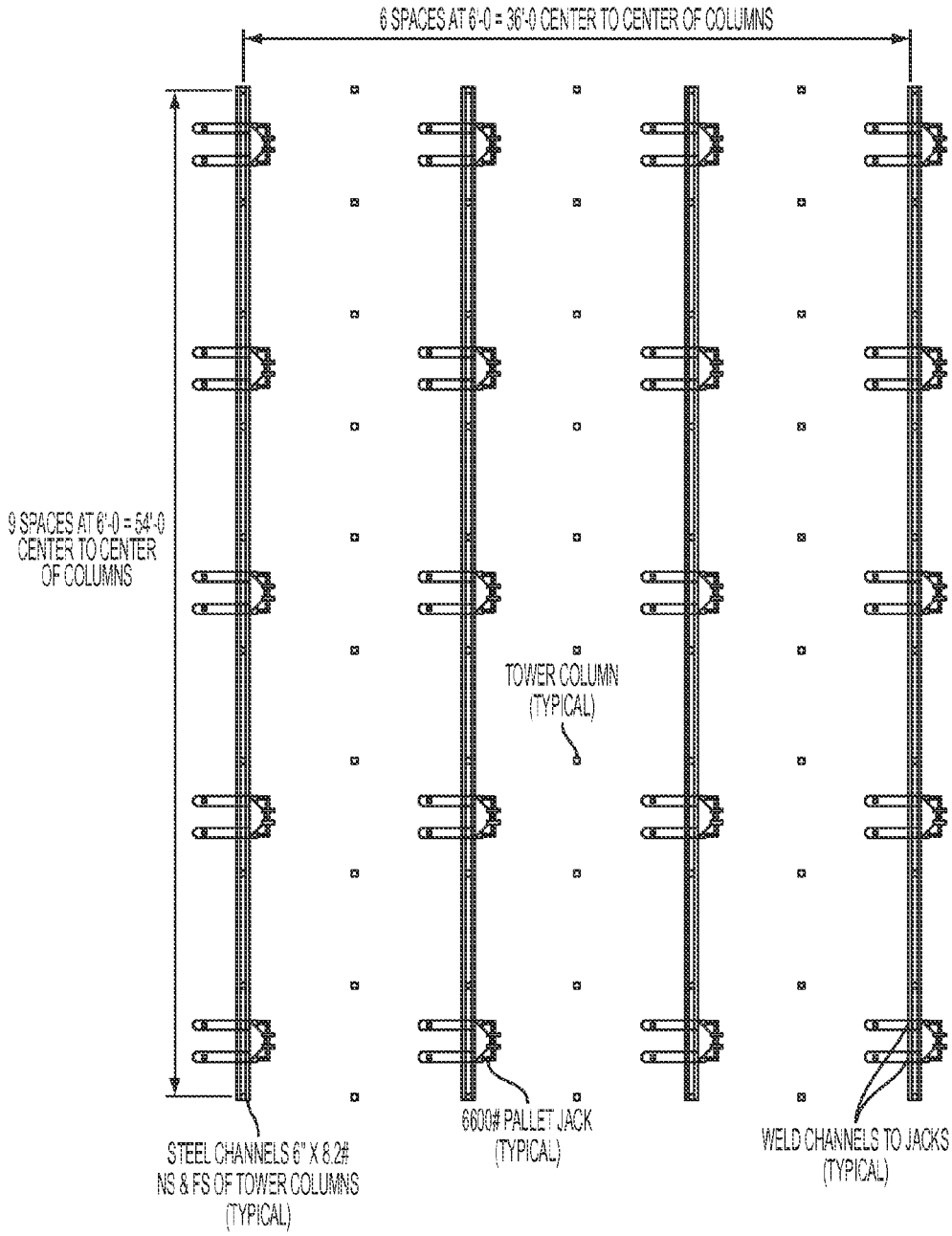
FIG. 5 is a plan view schematic of the six bay assembly section shown in FIG. 3, along a section just above the pallet jacks, with the vertical elements (columns and ladders) removed for clarity.

FIG. 5 shows an overhead view of the bottom transverse beams and an array of movable lifts used to lift and advance the structure. According to the embodiment shown in FIG. 5, the movable lifts are pallet jacks. While the embodiment shown in FIG. 5 shows the use of pallet jacks, any properly sized type of mechanism/structure/system may be used to advance the assembly structure.

Figure 6:
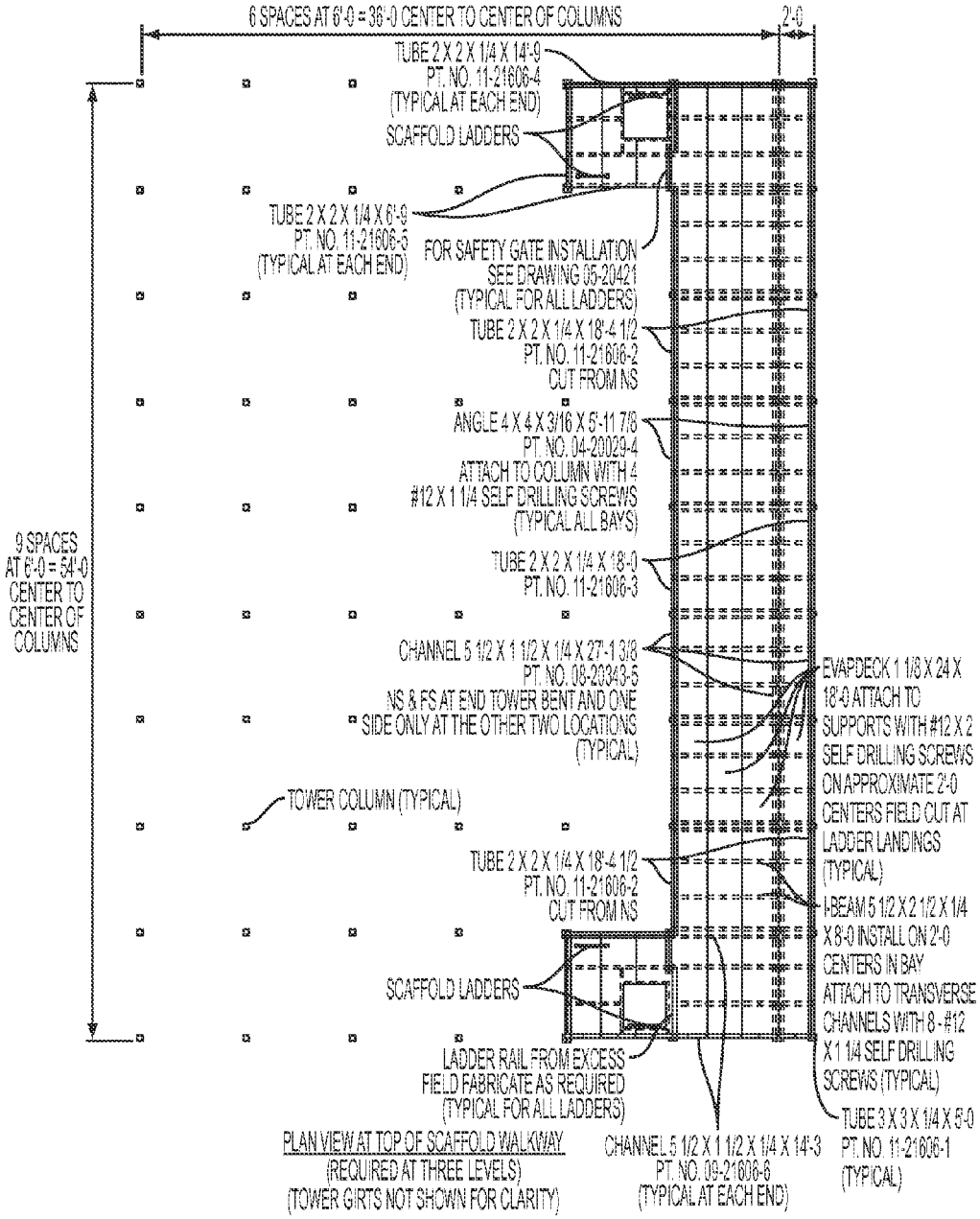
FIG. 6 is a plan view schematic of the top scaffold walkway shown in FIGS. 3 and 4 (ladders not shown).

FIG. 6 shows an overhead plan view of the top walkway structure, including ladder opening. The walkway structure and surface may be constructed of any material known or useful for scaffolding platforms, including by way of example, EvapDeck™ brand decking material.

Figure 7:
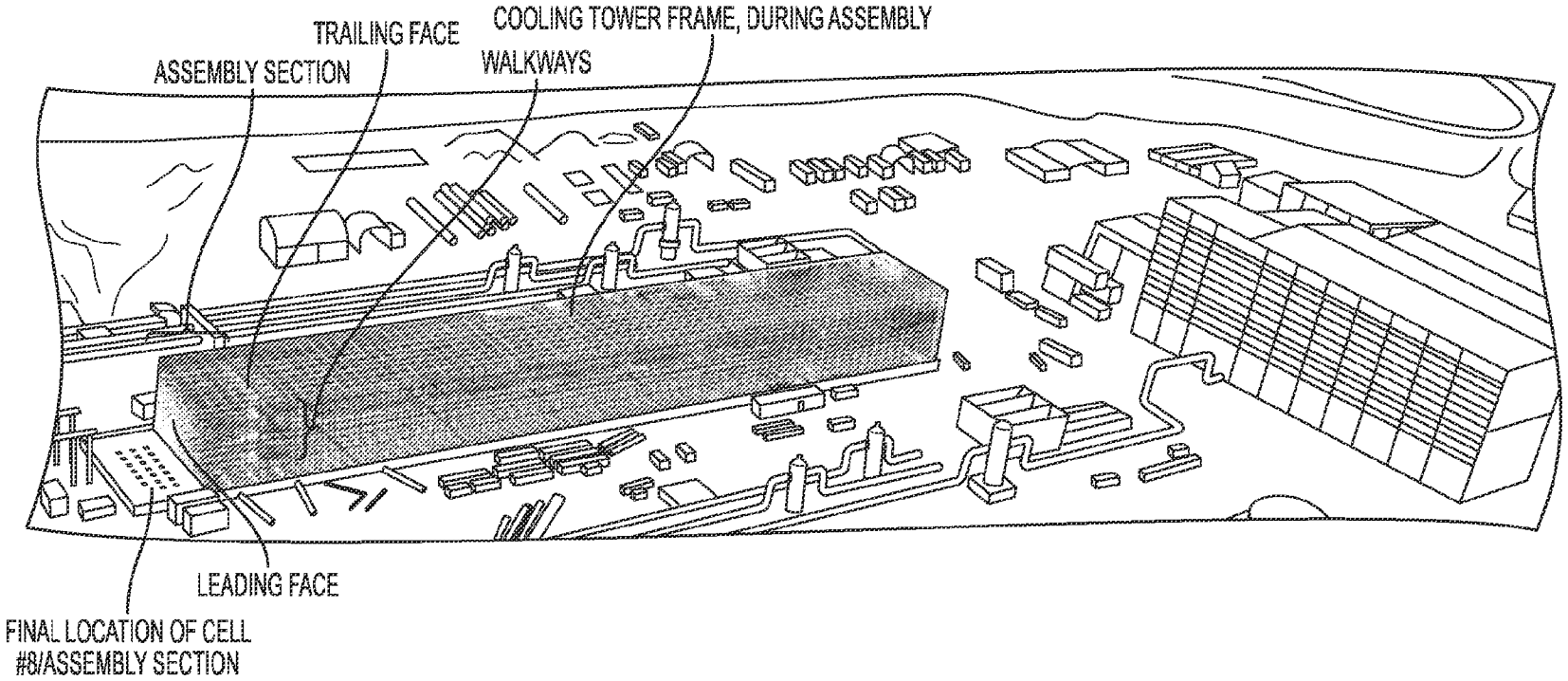
FIG. 7 shows the partially assembled cooling tower of FIG. 1, labeled to show certain parts of the invention.

FIG. 7 shows a cooling tower frame nearing the final stages of assembly. The assembly section has been advanced into cell #8, while the final sections of cell #7 are assembled from the trailing face of the assembly section. The advancing face of the assembly section (also referred to as the leading face, as shown in the drawing) is seen approaching the end of the cooling water basin. The safety walkways can be seen on the trailing face of the assembly section. For the cooling tower frame shown in FIG. 7 to be completed, the final section(s) of cell #7 will be completed from the walkways on the trailing face of the assembly section, and the assembly section will be advanced, one bay at a time, as sections are assembled behind it, until it has reached the end of the cooling water basin and reaches its final location at the end of cell #8. Once the final bays of cell #8 are assembled adjacent to cell #7, the walkways, railings and ladders will be removed.

The examples and figures described in this specification are provided for illustration only. The dimensions of the assembly section and the cooling tower frame that it can be used to assemble, as well as the devices and mechanisms for advancing the assembly section, can all be varied to meet various cooling tower size and assembly requirements.

The invention claimed is:

1. A method for assembling a multi-cell field-erected cooling tower frame, comprising:

assembling framework for a first section of the cooling tower frame, said first section having an advancing face and a trailing face;

affixing one or more scaffold walkways and railings in said first section adjacent to said trailing face;

advancing said first section a predetermined distance in a direction faced by said advancing face;

assembling a second section of the cooling tower frame, with said scaffold walkways on said trailing face of said first section supporting assembly workers as they assemble said second section;

when said second section of said cooling tower frame is assembled or nearly assembled, advancing said first section in a direction away from said second section to make room for assembly of a third section;

assembling a third section of the cooling tower frame, with said scaffold walkways on said trailing face of said first section supporting assembly workers as they assemble said third section;

assembling subsequent sections and advancing said first section following assembly of each subsequent section until said first section is advanced into a first section final location; and assembling a final section and attaching said final section to a last previously assembled section and to said first section.

2. A method according to claim 1, wherein said first section comprises an entire cooling tower cell.

3. A method according to claim 1, wherein said first section comprises a portion of a cooling tower cell.

4. A method according to claim 1, wherein said first section is lifted off the ground prior to each advancing step.

5. A method according to claim 4, wherein said first section is lifted off the ground by pallet jacks.

6. A method according to claim 1, wherein said cooling tower comprises 5 or more cooling tower cells.

7. A method according to claim 1, wherein said cooling tower is assembled on the surface of a cooling tower water basin.

8. A method according to claim 1, wherein each said assembled section other than said assembly section is assembled in a final location of said assembled section.

9. A method according to claim 1, wherein each cell of said cooling tower selected from the group consists of square cells where the cells have the same number of bays in each of the longitudinal and transverse directions.

10. A method according to claim 1, wherein structural elements for assembly of cooling tower sections are stored in said first section.

11. A method according to claim 1, further comprising removing said walkways and railways from said first section.

12. A method according to claim 1, wherein each cell of said cooling tower selected from the group consists of rectangular cells where the cells have a number of bays in the longitudinal direction that does not equal the number of bays in the transverse direction.

* * * * *